United States Patent [19]

Chagnot et al.

[11] Patent Number: 4,553,392

[45] Date of Patent: Nov. 19, 1985

[54] SELF PRESSURIZING, CRANK-TYPE STIRLING ENGINE HAVING REDUCED LOADING OF DISPLACER DRIVE LINKAGES

[75] Inventors: Bruce J. Chagnot, Athens; James G. Wood, Albany, both of Ohio

[73] Assignee: Stirling Technology, Inc., Athens, Ohio

[21] Appl. No.: 680,753

[22] Filed: Dec. 12, 1984

[51] Int. Cl.[4] ..... F02G 1/04

[52] U.S. Cl. ..... 60/517

[58] Field of Search ..... 60/517; 62/6

[56] References Cited

U.S. PATENT DOCUMENTS

| | | | |
|---|---|---|---|
| 4,327,550 | 5/1982 | Knoos | 60/522 |
| 4,335,884 | 6/1982 | Darche | 60/517 |
| 4,381,648 | 5/1983 | Balas, Jr. | 60/517 |

*Primary Examiner*—Allen M. Ostrager
*Attorney, Agent, or Firm*—Frank H. Foster

[57] ABSTRACT

An improved crank-type Stirling engine. A spring, preferably a gas spring, is linked between the displacer and the housing or alternatively the power piston. The spring is relaxed at substantially a mean position of the displacer to apply a centering force upon the displacer. The spring reduces the loading on the displacer drive linkage by itself exerting a centering force upon the displacer. If desired, displacer linkage forces may be reduced nearly to zero by designing the spring so that the spring constant and the masses upon which it operates are in resonance. The gas spring mechanism may include pump elements so that it will operate as a pump to charge the engine to operating pressure with atmospheric air during initial start up operation.

12 Claims, 6 Drawing Figures

SELF PRESSURIZING, CRANK-TYPE STIRLING ENGINE HAVING REDUCED LOADING OF DISPLACER DRIVE LINKAGES

TECHNICAL FIELD OF THE INVENTION

This invention relates generally to crank-type or kinematic Stirling engines and more particularly relates to an improvement for decreasing the size and cost of the engine and increasing the life of the displacer drive linkages while also providing a simple self pressurizing mechanism.

BACKGROUND ART

The inventions of this application were the subject of Disclosure Documents Nos. 129,280 and 129,281 filed in the U.S. Patent and Trademark Office on July 20, 1984.

Most of the world, and particularly developing countries, suffer from an inadequate supply of energy resources. There has, as a result, been substantial efforts toward building engines which can efficiently utilize those energy resources which are locally available. Such energy sources include wood, rice husks or other vegetative or animal waste products. A leading engine showing great promise is the Stirling engine which is capable of converting heat energy directly to mechanical energy.

Cost and durability are very important in such applications of Stirling engines. They must be sufficiently inexpensive that they are affordable for those who need them and must provide reliable operation without the need for frequent repair because they are often used in locations which are inaccessible to adequate repair facilities.

Particularly vulnerable in a crank-type Stirling engine are the linkages which drivingly connect the power output shaft of the Stirling engine to its displacer and power piston. In order to provide such linkages, which give a reasonable and acceptable life expectancy, the bearings in those linkages must be made large using conventional designs. If the loading forces on the displacer drive linkages are reduced, the bearings of those linkages may be made correspondingly smaller and will exhibit a longer lifetime.

It is therefore a purpose and object of the present invention to provide a means for reducing the loading forces in the displacer drive linkages without changing the operating characteristics of the engine. This results in longer lasting, smaller and less expensive bearings and linkages.

It is often desirable to construct a Stirling engine which is intended for the operation described above so that it utilizes normal atmospheric air as its working gas. Since such Stirling engines operate more efficiently with working gas at a higher mean pressure than atmospheric pressure, there have been a variety of designs suggested for pumps which may be driven by the crank shaft of the engine. With such a pump, the engine may be started with working gas at atmospheric pressure and is able to do enough work to pump itself up to operating pressure. However, pumps designed in the past for this purpose add substantial material and labor costs and complexity to the engine and thus unduly increase the sales price.

It is therefore a further purpose and object of the present invention to provide a self pumping mechanism requiring a minimum of additional structure within the engine.

BRIEF SUMMARY OF THE INVENTION

The present invention is an improvement in a Stirling engine of the type in which a reciprocating displacer is drivingly linked to a reciprocating power piston mounted in a housing or to some other means for driving the displacer. The improvement is a spring linked to the displacer. The spring is linked so that it is relaxed in substantially the mean position of the displacer and applies a centering force upon the displacer to reduce the loading of the displacer drive linkage. Preferably the spring is linked at one of its ends to a point located between the displacer and the linkage to be protected and at the other end of the spring to the housing of the crank-type Stirling engine although it may also be linked between the displacer and the power piston. Most preferred is a gas spring which can simultaneously be modified to include pumping check valves and passages so that it will pump up the engine to mean operating pressure and then begin operating as a gas spring.

Figure 1:
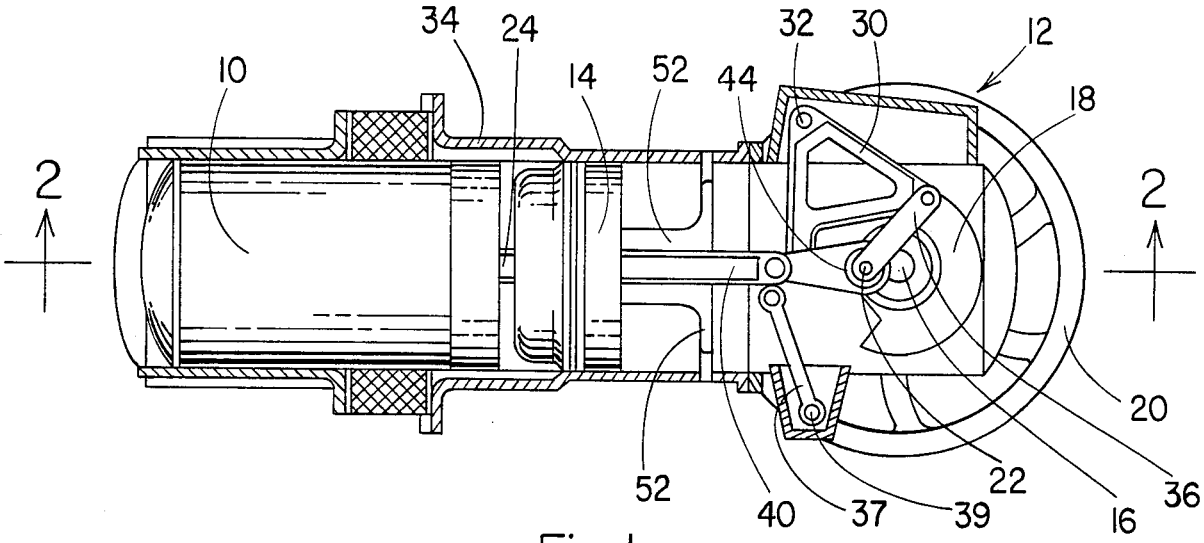
FIG. 1 is a view in axial section of a crank-type Stirling engine embodying the present invention.
Figure 2:
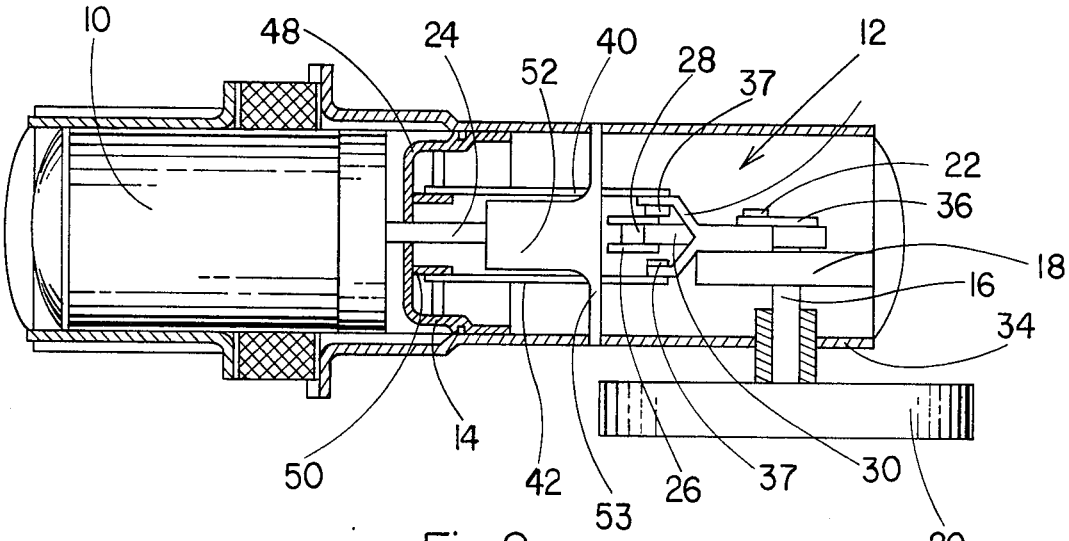
FIG. 2 is a view in axial section taken through a plane at 90° to the section plane of FIG. 1 substantially along the line of 2—2 of FIG. 1.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred embodiment of the invention which is illustrated in FIGS. 1–5 is a crank or kinematic type of Stirling engine in which a displacer 10 is connected through drive linkages, indicated generally as 12, to a power piston 14 and also to a power output crankshaft 16.

The invention is also applicable to multiple piston (alpha type) machines where the combined action of the pistons accomplish the displacement of the working gas. Such pistons are consequently serving both a piston and displacer function.

Attached to the crankshaft 16 is a conventional counterweight 18, a fly wheel 20 and a crank pin 22. The drive linkage from the crank pin 22 to the displacer comprises a connecting rod 24 which is axially fixed at one end to the displacer 10 and is pivotally connected at its opposite end to a pair of connecting links 26 and 28. These connecting links 26 and 28 are pivotally connected at their opposite ends between the end of the connecting rod 24 and a bell crank 30.

The bell crank 30 is pivotally mounted at pivot pin 32 to the engine housing 34. It is also connected through a connecting link 36 to the crank pin 22 and operates to drive the displacer in reciprocation at the appropriate phase with respect to the power piston 14. A link 37 is pivotally connected at one opposite end 39 to the housing 34 and at its opposite end to the connecting rod link 44 described below.

The power piston 14 is linked to the crank pin 22 through a pair of connecting rod links 40 and 42 which are pivotally linked to another connecting rod link 44. The connecting rod links 40 and 42 are pivotally connected to the piston 14 at a pair of tabs 48 and 49 which are fixed to the underside of the piston 14.

The linkages which are shown for linking together the power piston, displacer and power take-off crank shaft are one type of linkage and the invention contemplates the use of any of the other prior art linkage mechanisms which have been disclosed or which may be disclosed in the future for this purpose.

Figure 3:
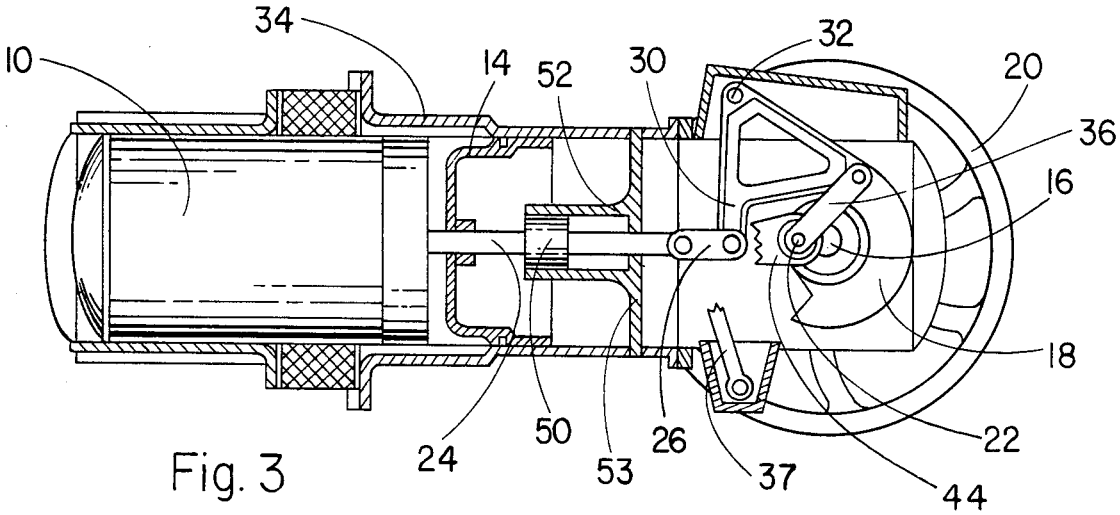
FIG. 3 is a view in axial section taken substantially in the same plane as in FIG. 1, but with the piston drive linkages removed and the piston and gas spring in section to reveal the interior mechanisms of the embodiment of FIG. 1.
Figure 4:
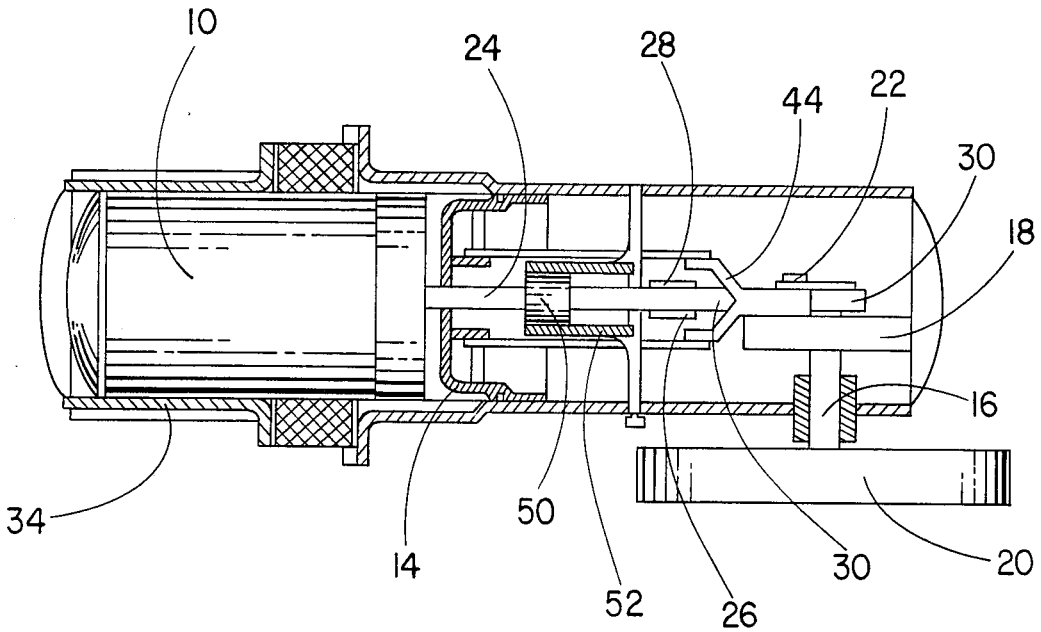
FIG. 4 is a view in axial section taken substantially through the same section plane as FIG. 2, but illustrating the interior of the gas spring pumping mechanism.

The improvement which is an embodiment of the present invention, has a gas spring piston 50 which is revealed in FIGS. 3 and 4 and which is fixed to the displacer connecting rod 24 for movement therewith. That gas spring piston 50 sealingly slides within a cylinder 52 which is axially mounted in the housing 34 upon a spider or web 53. The spider or web 53 has radially extending support structures which retain the cylinder 52 in its axial position, yet permits passage of working gas to its opposite sides and also has clearance space for the connecting rods 40 and 42.

The gas spring piston 50 reciprocating within the cylinder 52 forms a gas spring which is linked between the displacer 10 and the housing 34. These are, of course, two members of a gas spring or pump structure and their connections can be interchanged so that the piston could be fixed with respect to the housing while the cylinder could be fixed with respect to the displacer. As will be apparent to those skilled in the art, other gas springs, such as for example a bellows mechanism, may be substituted for the spring which is illustrated. In addition, mechanical springs may also be used as an alternative to a gas spring in embodiments of the invention.

Whatever the form of the spring, it is arranged so that it is relaxed in substantially the mean position of the displacer so that it applies essentially a centering force upon the displacer to reduce the loading on the displacer drive linkages. Thus, as the displacer is alternately decelerated and accelerated during its opposite excursions from its mean position, the forces which are applied to it to accomplish this acceleration or deceleration are applied at least in part by the spring. Those loads are transferred to the housing through the spring rather than through the displacer drive linkages.

If the spring is a simple gas spring arrangement, like that illustrated in FIGS. 3 and 4, with no additional passageways, then gas leakage into the interior of the gas spring will occur causing the mean pressure within the gas spring to approximately equal the mean pressure within the Stirling engine so that its relaxed position is at the mean position of the gas spring and will therefore exert the appropriate centering force vector. If this leakage is not adequate, conventional centering ports can be used to insure the correct mean pressure.

Figure 6:
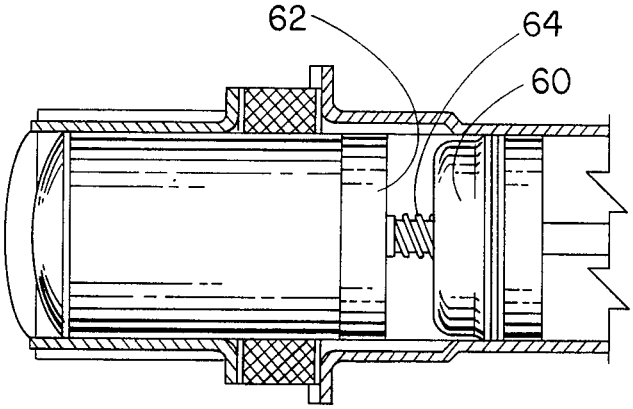
FIG. 6 is a view in axial section illustrating an alternative embodiment of the invention utilizing a mechanical spring linked between the displacer and the piston.

Although it is preferred that the spring directly link the displacer to the engine housing, the forces applied to the displacer by the spring may be indirectly linked to the housing by linking the spring directly to the power piston as illustrated in FIG. 6 with a mechanical spring. In FIG. 6 the piston 60 is linked to the displacer 62 through an intermediate mechanical spring 64 which is designed to be relaxed in substantially the mean position of the displacer relative to the piston 60.

All springs have associated with them an engineering parameter called a spring constant which relates the force applied by the spring to the linear displacement of the spring. In embodiments of the present invention the spring constant may be sufficiently small that minor reduction in loading of the displacer drive linkages is accomplished. In some designs, however, the spring constant may be increased with a corresponding reduction in the forces applied to the linkages. It is, of course, also possible to design the masses which are linked to the displacer and the spring constant to provide for resonance. With a resonant system the loading of the displacer drive linkages is theoretically reduced to a minimum. The linkages, of course, would continue to function to assure that the displacer is properly phased and cannot wander from its phase relationship.

Because provision of a means for the self-pumping of the engine up to operating pressure is desirable, as explained above, the gas spring described above provides an opportunity to accomplish self-pumping operation with a minimum of additional structure. In particular, the addition of the appropriate check valves and passageways permit the gas spring to operate as a pump during start-up conditions and then operate as a gas spring in the manner described above.

Figure 5:
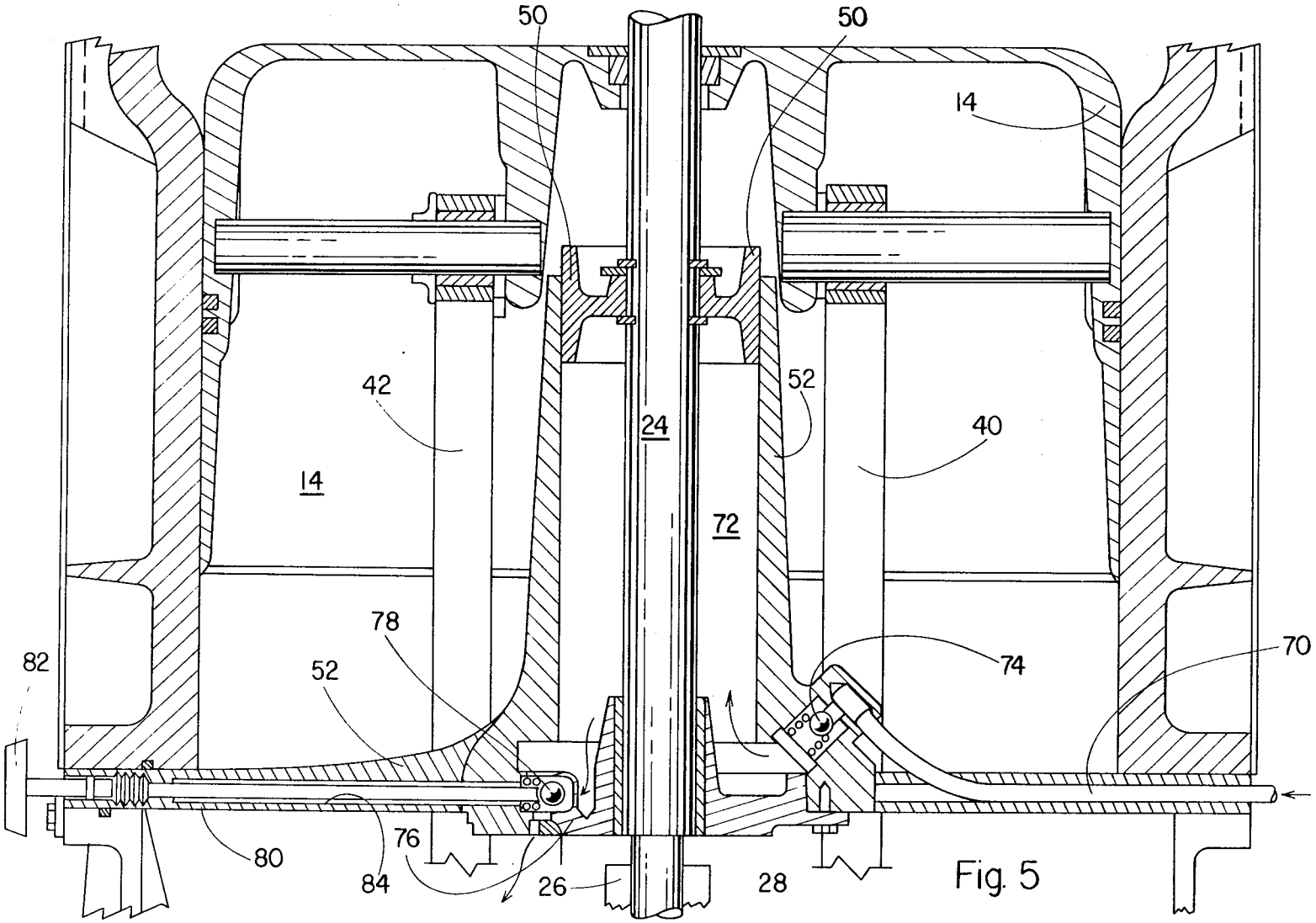
FIG. 5 is a detailed view of the gas spring and power piston segment of the embodiment illustrated in FIG. 1.

Referring therefore to FIG. 5, the gas spring is provided with an inlet passageway 70 which is connected in communication between the interior 72 of the gas spring and ambient atmosphere. It is provided with a conventional check valve 74 which permits gas flow into the gas spring from the ambient atmosphere, but blocks flow in the reverse direction. Similarly, a passageway 76 is provided from the interior 72 of the gas spring to the gas space within the engine. This passageway 76 is also provided with a check valve, a ball check valve as illustrated having a ball 78, so that gas may flow from the interior 72 of the gas spring into the gas space.

If the pump outlet passage 76 is provided only with a simple check valve then the Stirling engine can be heated to initiate operation and will operate with an initial gas charge at atmospheric pressure to begin the work of reciprocating the piston 50 causing it to pump air into the gas space of the engine. This will continue until the mean operating pressure within the Stirling engine in absolute bars is equal to the pressure ratio of the pump formed by the gas spring. For example, if the piston 50 has a displacement which reduces the interior volume of the gas spring by approximately a factor of $3.6^{1.4}$, then atmospheric air will be pumped into the Stirling engine until its pressure is approximately 6 bars absolute.

After that maximum pressure is reached, the gas spring will then operate between a maximum pressure of 6 bars absolute and a minimum pressure of 1 bar absolute, that is at atmospheric pressure. Thus, the spring will then operate as a gas spring with the advantageous features described above and at a mean gas pressure of 3.5 bars absolute.

In addition, a valving means may be provided so that it can completely block gas passage through the pump outlet passageway 76. Although any of a variety of known fluid valves might be used, we prefer to provide the simple structure of a rotatable rod 80 fixed to a manually rotatable knob 82 and threadedly engaged within a radial bore 84 in the spider arm 52 and which can seat against the ball 78. Rotation of the rod 80 causes axial translation of the rod which forces the ball 78 against its seat, thus blocking the passage of gas in either direction through the outlet passage 76.

With the passageway 76 completely blocked, gas may no longer pass into the gas space and therefore the interior 72 of the gas spring may increase above the mean gas pressure of the engine during its compression stroke. With the outlet passage 76 blocked, leakage of working gas past the piston 50 into the interior 72 of the gas spring will eventually bring the mean pressure of the gas spring into equality with the mean operating pressure of the Stirling engine. This will be 6 bars in the example given above in which the pressure ratio of the gas spring is 6 to 1. Therefore, with the passageway 76 blocked the spring operates with a mean pressure double that at which it operates with the passageway 76 open. There are, therefore, two selectable spring constants which can be selected at which the spring is operated. Of course, a valve having a continuously variable orifice can be connected to provide a metered flow of gas through the passageway 76 and accomplish intermediate spring constants, although the stability of the adjustment of such a valve may be difficult to maintain.

While certain preferred embodiments of the present invention have been disclosed in detail, it is to be understood that various modifications in its structure may be adopted without departing from the spirit of the invention or scope of the following claims.

We claim:

1. An improved Stirling engine of the type wherein a reciprocating displacer is drivingly linked to a reciprocating power piston mounted in a housing or to other displacer drive means, wherein the improvement comprises: a spring linked to a point located between said displacer and the drive linkage to be protected and relaxed in substantially the mean position of said displacer for applying a centering force upon said displacer to reduce the loading on the displacer drive linkage.

2. An engine in accordance with claim 1 wherein said spring is linked at one end to said displacer and at its other end to said power piston.

3. An engine in accordance with claim 1 wherein said spring is linked at one end to said displacer and at its other end to said housing.

4. An engine in accordance with claim 3 wherein said spring is a gas spring.

5. An engine in accordance with claim 4 and further comprising a first check valve connected in communication between said gas spring and the ambient atmosphere for permitting gas flow into said gas spring and a second check valve connected in communication between said gas spring and the interior gas space of said engine for permitting gas flow into said engine.

6. An engine in accordance with claim 5 and further comprising means for blocking gas flow through said second check valve.

7. An engine in accordance with claim 5 wherein the pressure ratio of said gas spring is equal to the desired mean operating pressure of the engine in bars.

8. An engine in accordance with claim 1 wherein the mass of said displacer and its linkages and the spring constant of said spring are selected for resonance.

9. An engine in accordance with claim 1 wherein said displacer has a connecting rod extending axially through said power piston and wherein said spring comprises a gas spring having one of its two relatively movable parts mounted to said rod and the other mounted in said housing and spaced from said piston.

10. An improved Stirling engine of the type wherein a reciprocating displacer is drivingly linked to a reciprocating power piston mounted in a housing or to some other displacer drive means and wherein the displacer drive linkage includes a connecting rod extending centrally through said piston, wherein the improvement comprises: a pump, including a piston member and a cylinder member mounted coaxially of said rod, one of said members connected to said rod and the other member connected to said housing, said pump including check valves and passages communicating with the ambient atmosphere and the internal gas space of said housing for pumping gas into said gas space.

11. An engine in accordance with claim 10 and further comprising means for blocking gas flow through said second check valve.

12. An engine in accordance with claim 10 wherein the pressure ratio of said pump is equal to the desired mean operating pressure of the engine in bars.

* * * * *